US006299140B1

(12) United States Patent
Kamljuk

(10) Patent No.: US 6,299,140 B1
(45) Date of Patent: Oct. 9, 2001

(54) HOIST DRIVEN BY THE TRANSFER GEARBOX OF A VEHICLE

(76) Inventor: Alexandr Konstantinovich Kamljuk, 137-24 Partizanski Ave., 220102 Minsk (BY)

( * ) Notice: Subject to any disclaimer, the term of this patent is extended or adjusted under 35 U.S.C. 154(b) by 0 days.

(21) Appl. No.: 09/310,923

(22) Filed: May 13, 1999

(30) Foreign Application Priority Data

Nov. 19, 1996 (BY) ..... 961065

(51) Int. Cl.[7] ..... B66D 1/00
(52) U.S. Cl. ..... 254/328; 254/345
(58) Field of Search ..... 254/328, 343, 254/344

(56) References Cited

U.S. PATENT DOCUMENTS

| | | | | |
|---|---|---|---|---|
| 1,493,401 | * | 5/1924 | Steel | 254/328 X |
| 2,067,388 | * | 1/1937 | Garner, Jr. | 254/328 X |
| 2,718,377 | * | 9/1955 | Ward | 254/328 |
| 2,766,966 | * | 10/1956 | Roessler | 254/328 X |
| 2,799,402 | * | 7/1957 | Norman | 254/328 X |
| 3,788,605 | * | 1/1974 | Johnson | 254/328 X |
| 3,885,656 | * | 5/1975 | Michling et al. | 254/344 |
| 4,078,770 | * | 3/1978 | Yates et al. | 254/328 |
| 4,093,034 | * | 6/1978 | Curley et al. | 254/328 X |
| 4,162,713 | * | 7/1979 | Heitman et al. | 254/328 X |
| 4,328,954 | * | 5/1982 | Logus | 254/344 |
| 4,434,972 | * | 3/1984 | Charles | 254/344 |
| 4,746,100 | * | 5/1988 | Davenport et al. | 254/328 X |
| 5,860,635 | * | 1/1999 | Morfitt et al. | 254/344 |
| 5,970,713 | * | 10/1999 | Parkins et al. | 254/343 |

OTHER PUBLICATIONS

Braden Model MS50, Braden Winch Co., Broken Arrow, Oklahoma (Brochure).

ITAG SAEJ706a, ITAG, Germany (Brochure).

* cited by examiner

*Primary Examiner*—Emmanuel M. Marcelo
(74) *Attorney, Agent, or Firm*—David Newman Chartered

(57) ABSTRACT

Traction and traction-loading hoists which are mounted on vehicles for improving their progression capability, for helping other vehicles which are blocked, for dragging loads onto the platforms of vehicles as well as for lifting or lowering loads. The hoist of the present invention comprises the following members mounted on two supports: a winding drum, a winding drum switching mechanism that disconnects the drum for unwinding more rapidly the hoist cable, a reduction gear which is in the shape of one conical and one planetary gears connected by a linking shaft and has a lower reduction ratio than that of the current ones; and a mechanism for stopping the winding drum which is made in the shape of a toothed free-wheel clutch. In order to lower a load which has been previously lifted, the hoist comprises a brake system usually connected to an energy accumulator. In order to increase the braking action, the hoist may also include a braking chamber having its control connected to the clutch control of the vehicle. The potential yield of this hoist is higher than that of similar devices.

12 Claims, 7 Drawing Sheets

HOIST DRIVEN BY THE TRANSFER GEARBOX OF A VEHICLE

RELATED PATENT

This patent application stems from PCT/BY97/00008 by inventor Alexandr Konstantinovich Kamljuk, entitled HOIST DRIVEN BY THE TRANSFER GEARBOX OF A VEHICLE, for which priority and the benefit of the earlier filing dates of the parent PCT patent application, and patent application no. 961,065 of Belarus, filed Nov. 19, 1996 is claimed for common subject matter pursuant to 35 U.S.C. §119.

The invention relates to hoists of vehicles, in particular, and can be used for improving their cross-country capability, for helping other blocked vehicles, for dragging loads onto the platforms of vehicles, for lifting and lowering loads and represents a new type of pulling and pulling-lifting hoists.

BACKGROUND OF THE INVENTION, THEREFOR

A, hoist is known in the art to comprise a winding drum, a reduction gear, a two-position clutch, and a control mechanism Inventor's Certificate U.S. Ser. No. 1,505,886, cl. Pub. 1989. This hoist does not provide automatic stop of the winding drum when the hoist is switched off.

A, vehicle hoist is known in the art to comprise a winding drum mounted on two supports and a reduction gear the input shaft of the vehicle hoist is connected with the engine of the vehicle through clutch and disengageable power take-off shaft, as well as a mechanism of the winding drum switching off at unwinding of the cable A. S. Antonov. Army Vehicles. Part 2. M. Military Publisher, 1970, p. 376–385, FIG. XVII.5. This hoist has a small pulling speed, low efficiency and large specific mass (mass of hoist per maximum pulling force).

From the technical point the closest to the declared solutions the hoist driven by the transfer gearbox of a vehicle comprising a winding drum, a reduction gear, and a winding drum switching and stopping mechanisms mounted on two supports Hoist Braden MS 50: Publicity Brochures. Guide on installation, Service and Maintenance Work. This hoist has the same disadvantages as the previous one. To increase the cable pulling speed the worm reduction gear ratio was reduced. The reduction gear became non-self-breaking that caused the necessity of installation of additional brakes: on the winding drum, on the worm of the reduction gear, and on the drive that complicates the construction and control, reduces the reliability of the hoist and increases its specific mass.

SUMMARY OF THE INVENTION

The task of the invention is the increase of pulling speed and efficiency, the simplification of control, the reduction of specific mass, and the simplification of manufacturing and service.

The increase of pulling speed and, consequently, the permissible capacity of the hoist in comparison with those of the known hoist is provided by means of the reduction gear with small gear ratio and of non-self-breaking type and due to the presence of the special mechanism which automatically stops the winding drum at drive disengagement and prevents the unwinding of the loaded cable. Thus, the gear ratio of the reduction gear of the hoist is decreased between 2.5 and 3 times, in comparison with that of the prior art hoist, and its efficiency is increased to 0.92, 5 times reduction of its friction losses. The simplification of control is provided by automatic stop of the winding drum at drive disengagement and by means of connection of the hoist braking chamber control with the clutch control of the vehicle, thus, the reliability of the drum braking increases as well. Making the reduction gear compound and placing its components on the external sides of the supports give the possibility to place the winding drum between the supports, having lengthened it to the reduction gear width that permits to reduce the, number of cable layers on winding drum without reduction of its cable capacity and to reduce the input torque on the winding drum drive as well as in more than 1.5 times reduced the specific mass of the hoist (mass of the hoist relative to maximum pulling force) as compared to the known hoist of the similar purpose. In comparison with the norms for newly designed vehicle hoist according to, the hoist has between 2.0 and 2.8 times (for the hoist of a pulling-lifting function and for the hoist of a pulling function, respectively) smaller specific mass (mass of a hoist relative to maximum pulling force) with double safety margin of the hoist.

The stated task is solved in the following way: in the hoist driven by the transfer gearbox of a vehicle comprising a winding drum, a reduction gear, and a winding drum switching and stopping mechanisms mounted on two supports, the reduction gear is made in the shape of conical and a planetary gears connected by a linking shaft, the winding drum stopping mechanism is made in the shape of a toothed free-wheeling clutch that connects one of the shafts transferring torque to the winding drum with one of supports.

The toothed free-wheeling clutch of the hoist is made in the shape of two counter sprung half-clutches with butt-end forced and wedged teeth, one of half-clutches has an extended forced tooth, the other has a locking ring with a slot and butt-end wedged teeth, the extended forced tooth enters into the slot of the locking ring, on the half clutches the wedged teeth are made with a circle shift relative to the forced tooth by the half of the extended forced tooth width.

The winding drum switching mechanism is made in the shape of a loaded by spring sun gear mounted on the linking shaft and connected with the air cylinder fixed on one of supports.

To extend the field of the hoist application and its use not only as a pulling one but as a lifting one as well, between the support and an additional shaft of the toothed free-wheeling clutch there is installed a brake normally switched on an energy accumulator. The brake is equipped with a braking chamber and its control for braking action reinforcement at the moment of stopping the load in the suspended state and for taking up the dynamic tension originating in this case and braking reduction at lowering the load.

For co-ordination of the joint work of the clutch of the vehicle and the braking chamber providing automatic engagement or disengagement of the braking chamber at clutch disengagement or clutch engagement, the braking chamber control is connected to the clutch control of the vehicle by means of a two-circuit valve.

Additional objects and advantages of the invention are set forth in part in the description which follows, and in part are obvious from the description, or may be learned by practice of the invention. The objects and advantages of the invention also may be realized and attained by means of the instrumentalities and combinations particularly pointed out in the appended claims.

BRIEF DESCRIPTION OF THE DRAWINGS

The accompanying drawings, which are incorporated in and constitute a part of the specification, illustrate preferred embodiments of the invention, and together with the description serve to explain the principles of the invention.

1—support;
2—support;
3—vehicle;
4—winding drum;
5—cable;
6—hook;
7—linking shaft;
8—conical gear;
9—planetary gear;
10—carrier;
11—crown;
12—toothed free-wheeling clutch;
13—spring;
14—half-clutch;
15—half-clutch;
16—forced teeth of half-clutches;
17—wedged teeth of half-clutches;
18—extended forced tooth;
19—locking ring;
20—wedged teeth of locking ring;
21—slot of locking ring;
22—shoulder;
23—additional shaft;
24—spring;
25—sun;
26—air cylinder;
27—energy accumulator;
28—brake;
29—braking chamber;
30—valve;
31—tubing;
32—two-circuit valve.

BEST MODE FOR CARRYING OUT THE INVENTION

Figure 1:
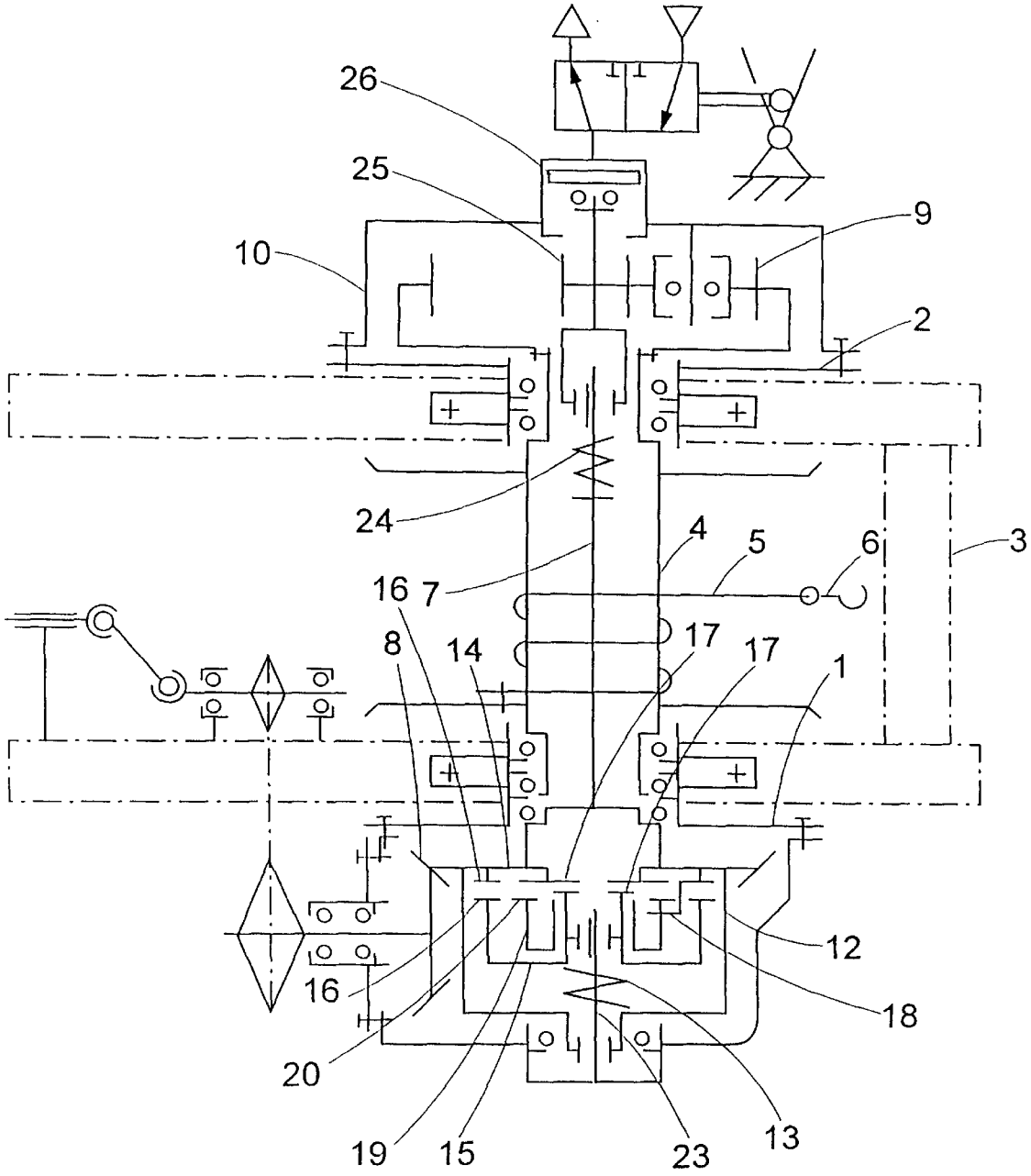
FIG. 1 is a schematic diagram of the hoist with stopped carrier of planetary gear.
Figure 2:
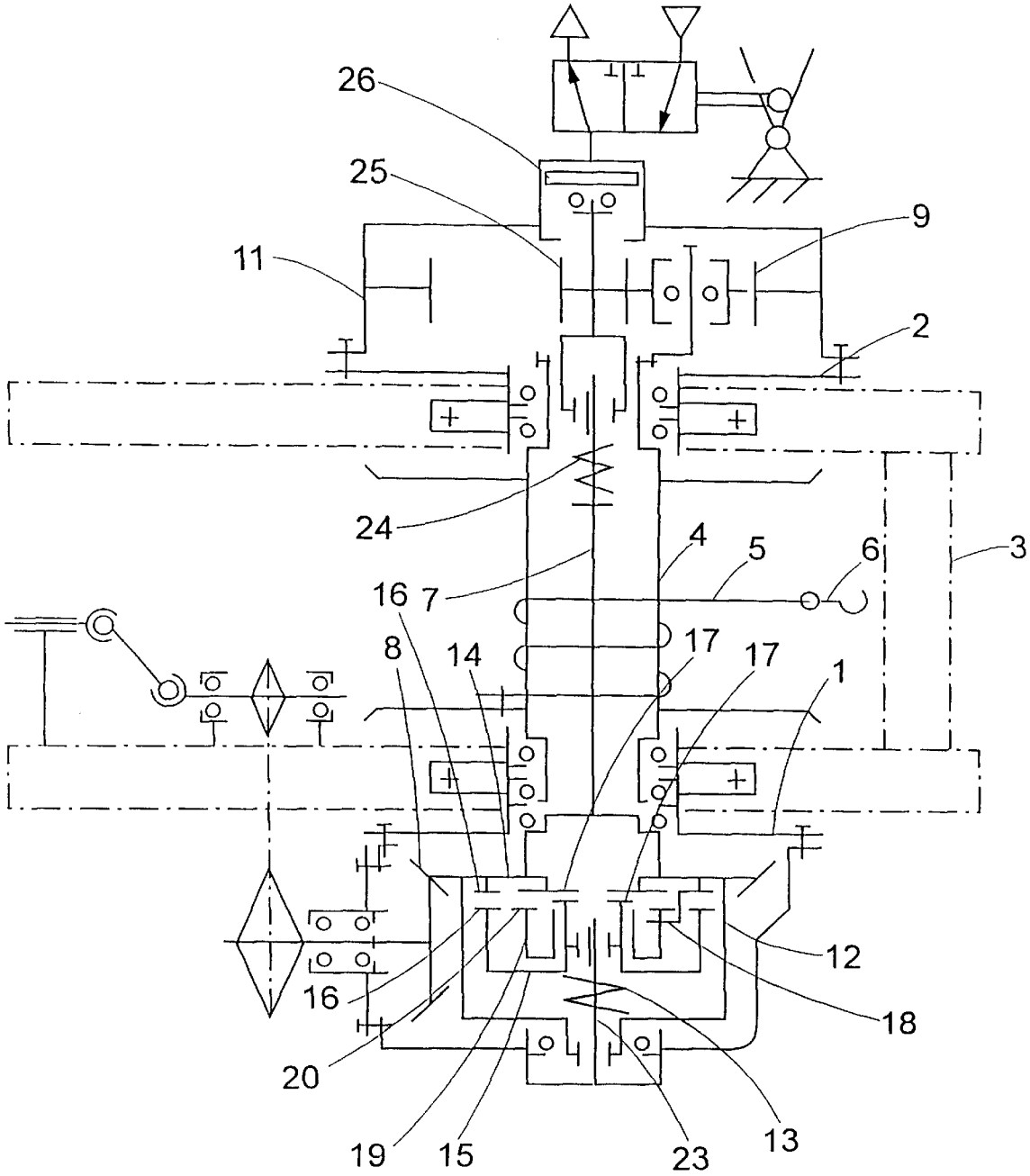
FIG. 2 is a schematic diagram with stopped crown of planetary gear.
Figure 3:
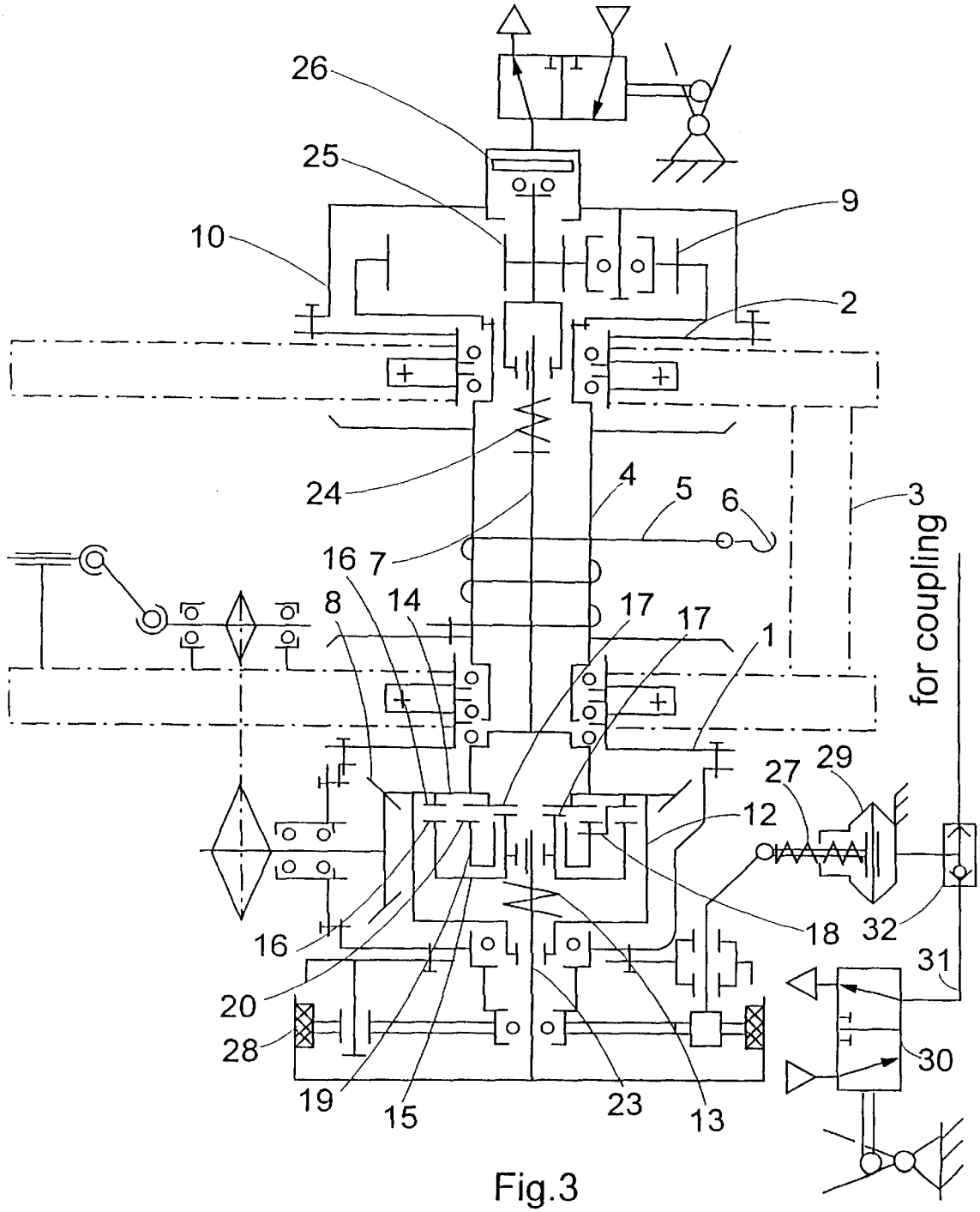
FIG. 3 is a schematic diagram of the hoist with stopped carrier of planetary gear, brake, energy accumulator, braking chamber and its control.
Figure 4:
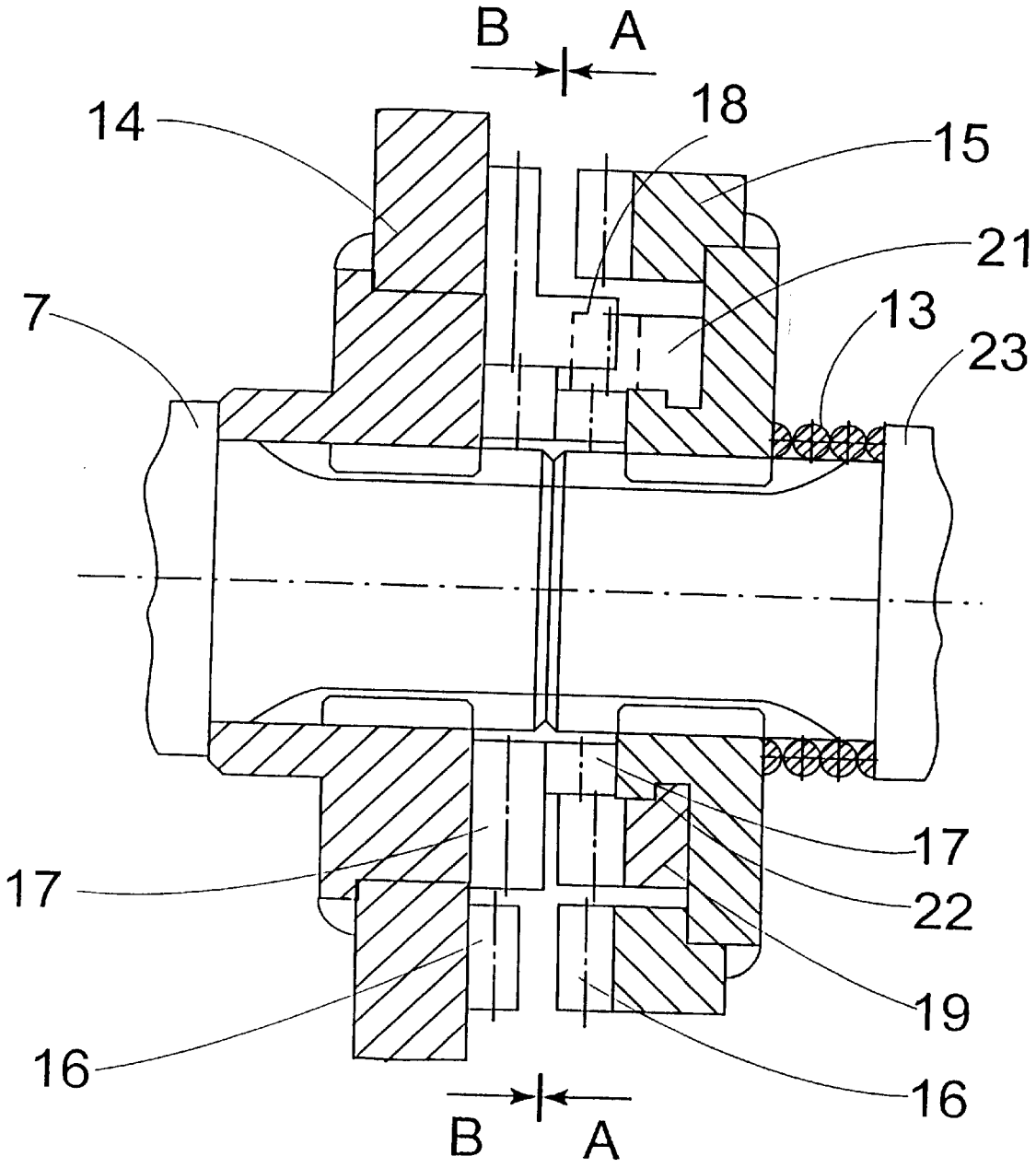
FIG. 4 illustrates a toothed free-wheeling clutch, sectional view.
Figure 5:
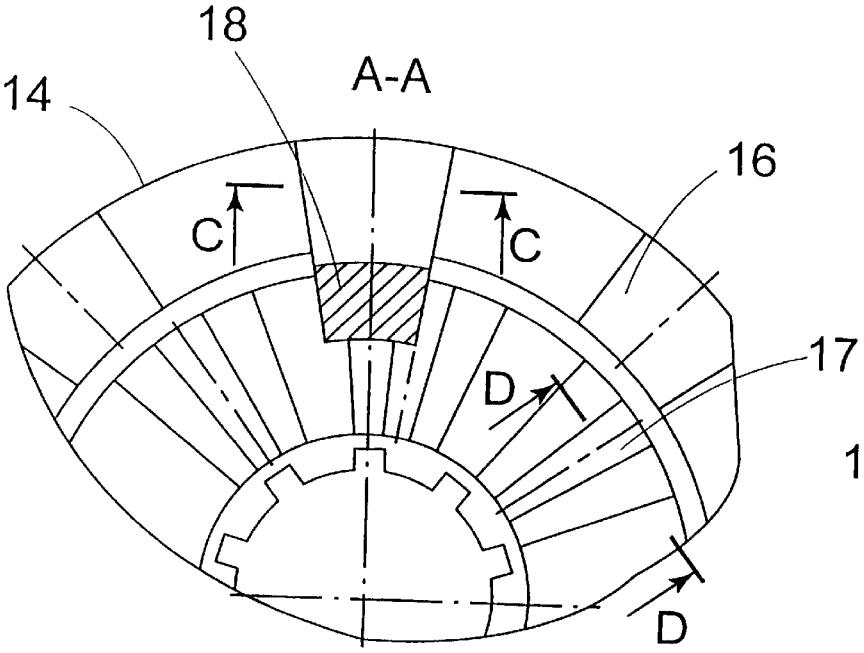
FIG. 5 illustrates a section A—A in FIG. 4.
Figure 7:
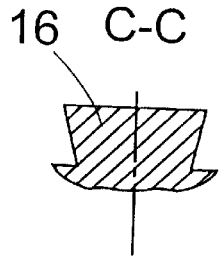
FIG. 7 illustrates a section C—C in FIG. 5, cross-section of the forced tooth.
Figure 6:
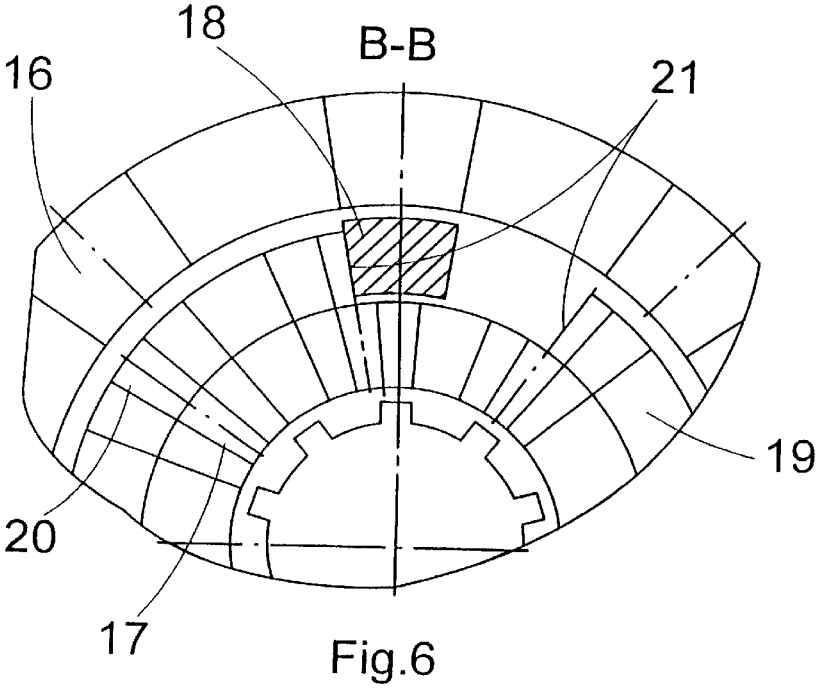
FIG. 6 illustrates a section B—B in FIG. 4.
Figure 8:
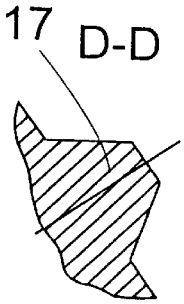
FIG. 8 illustrates a section D—D in FIG. 5, cross-section of the wedged tooth.
Figure 9:
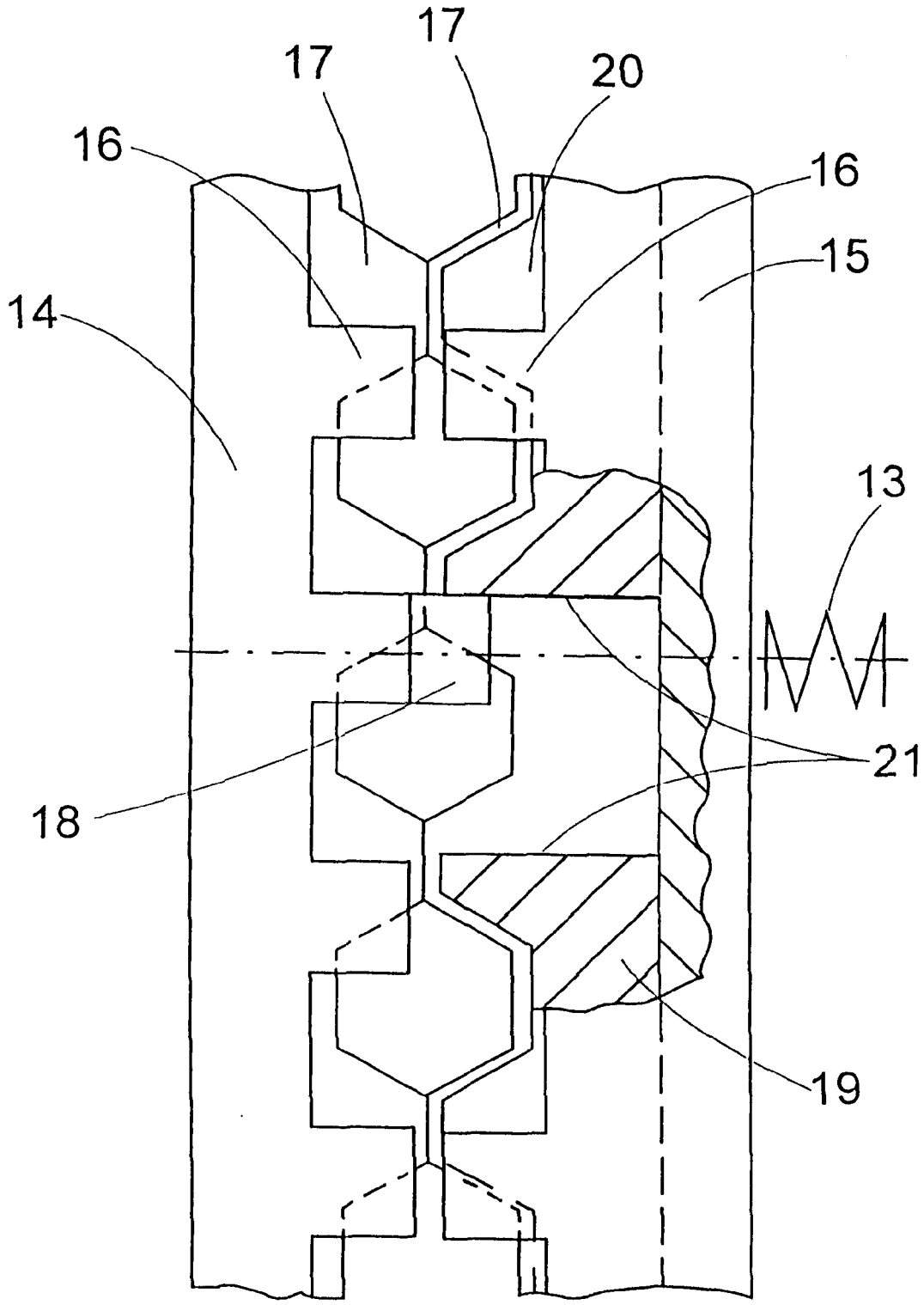
FIG. 9. Shows on the schematic developed view of the clutch there is such an arrangement of parts when half-clutches are disengaged.
Figure 10:
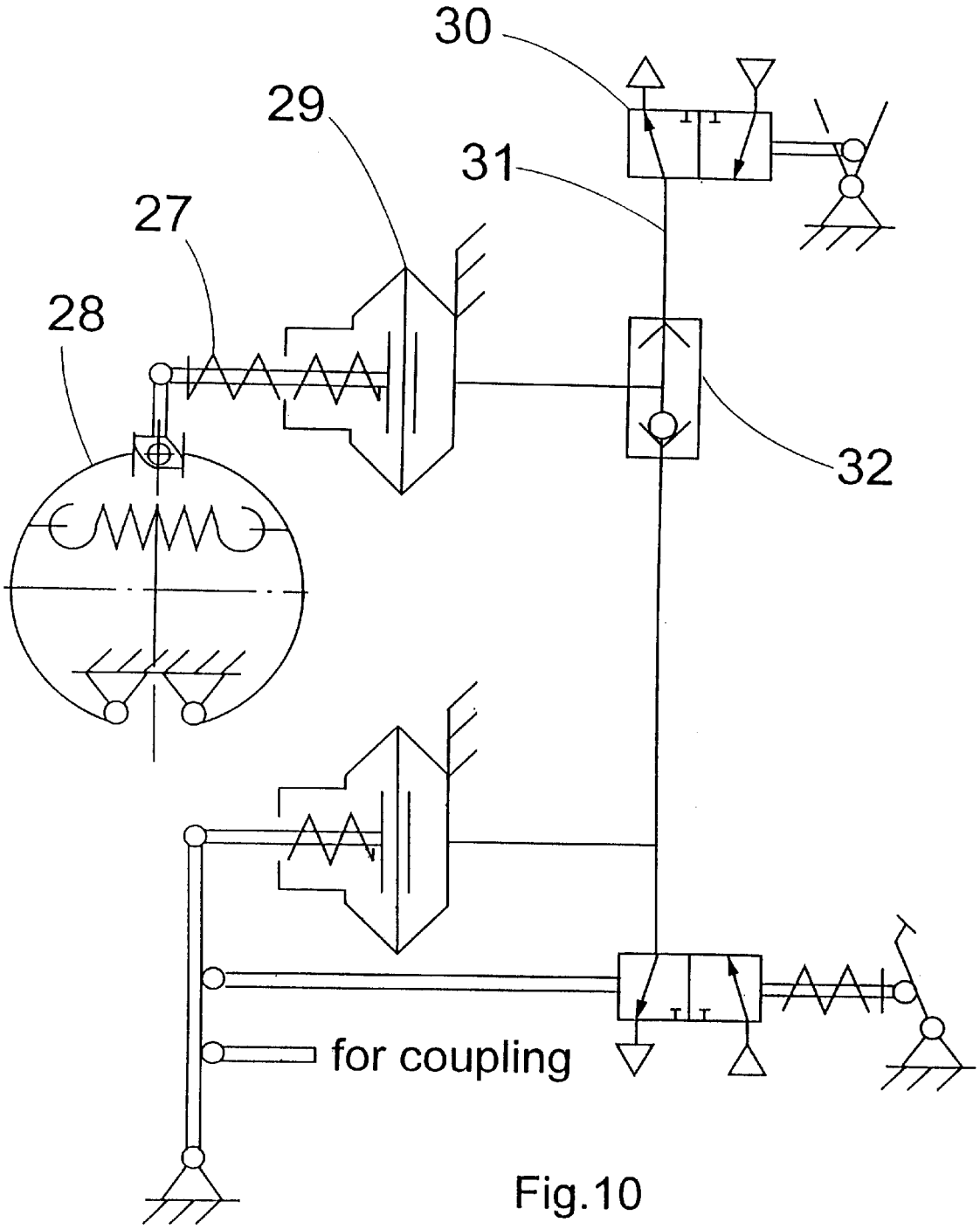
FIG. 10—diagram of the hoist control. The numbers indicate following.

Below there are versions of the suggested hoist. The pulling hoist has two supports 1 and 2 for its fixing on vehicle 3, winding drum 4 with cable 5 and hook 6 fixed on the winding drum 4 mounted on supports 1 and 2. The reduction gear of the hoist consists of two gears connected by linking shaft 7: conical gear 8 and planetary gear 9 with stopped carrier 10 or crown 11 by means of their fixing on support 2. The stopping mechanism of the winding drum 4 is made in the shape of toothed free-wheeling clutch 12 which consists of two half-clutches 14 and, 15 counter sprung by spring 13 which allows winding drum 4 to rotate freely at pulling rotation and stops winding drum 4 at the beginning of its rotation in reverse direction. One half-clutch of the stopping mechanism, a rotating one, is mounted on one of the rotating shafts transferring torque to winding drum 4, and the other, non-rotating, must be connected to support 1. One of the best versions of the hoist when the stopping mechanism is placed in the area of conical gear 8 is represented in FIGS. 1–3. On half-clutches 14 and 15 there are butt-end teeth: forced ones 16 transferring the torque and wedged ones 17 by means of interaction of which half-clutches 14 and 15 are engaged and disengaged. In half-clutch 14 one forced tooth 18 is made extended along the axis of rotation of half-clutch 14 and directed towards it as well. In the other half-clutch 15 in its turned groove there has been installed locking ring 19 with wedged teeth 20 having slot 21 through a long radial axis of the two neighbouring teeth 20. In the axial direction locking ring 19 is fixed by shoulder 22 entering specially turned groove in half-clutch 15. Locking ring 19 is a snap one and can move circumferentially, its setting on the external diameter of the crown of wedged teeth 17 of half-clutch 15 is done with preload. Number, profile, pitch accordingly to forced 16 and wedged 17 teeth of both half-clutches are equal. Number, profile, pitch of wedged teeth 20 of locking ring 19 are the same as those of wedged teeth 17 of half-clutches 14 and 15 but teeth 20 of locking ring 19 are reduced to exclude the engagement of the tops of wedged teeth 20 of locking ring 19 and wedged teeth 17 of half-clutch 14 when the half-clutches are rotating relative one another. Owing to this forced teeth 16 of half-clutches 14 and 15 are made lower than wedged ones 17. The space width between wedged 17 and between forced 16 teeth of half-clutches 14 and 15 is made so that to allow for formation of side clearance necessary for unimpeded disengagement of forced teeth 16 when half-clutches 14 and 15 are being disengaged. To increase the safety of engagement of forced teeth 16 their sides are under cut to the base (FIG. 7). In FIGS. 1–3 there are shown hoists in which half-clutch 14 with extended tooth 18 is mounted on the rotating linking shaft 7 and half-clutch 15 with locking ring 19 is mounted on non-rotating additional shaft 23 connected to support 1. The places of half-clutches 14 and 15 can be interchanged: half-clutch 14 with extended tooth 18 can be put on non-rotating additional shaft 23 and half-clutch 15 with locking ring 19 on rotating linking shaft 7. At the same time for the performance of tooth-free-wheeling clutch 12 as the stopping mechanism which allows winding drum 4 to rotate freely only in the direction of pulling rotation, wedged teeth 17 of half-clutches 14 and 15 in clutch 12 must be shifted to the half of the width of extended tooth 18 relative to the forced ones 16 in the direction of pulling rotation of rotating linking shaft 7 if half-clutch 14 with extended tooth 18 is installed on rotating linking shaft 7, and wedged teeth 17 of half-clutches 14 and 15 must be shifted in relation to forced ones 16 in the direction reverse to pulling rotation of rotating linking shaft 7 if half-clutch 14 with extended tooth 18 is installed on non-rotating additional shaft 23 connected to support 1. Extended tooth 18 of half-clutch 14 enters into slot 21 of locking ring 19 and serves for rotation of locking ring 19 relative to half-clutch 15. The width of slot 21 of locking ring 19 and the width of extended tooth 18 are done so that (when locking ring 19 turns up to the stop by extended teeth 18), teeth 20 were placed opposite teeth 17 of half-clutch 14 and their radial axles matched. The winding drum switching mechanism is made in the shape of the loaded by spring 24 and mounted on linking shaft 7 a sun 25, which is connected to air cylinder 26 fixed on stopped carrier 10 or crown 11 of planetary gear 9 which are connected to support 2. To extend the field of the hoist application due to its use not, only as a pulling one but also as a lifting one, in its design between support 1 and additional shaft 23 (FIG.3) there has been introduced a brake 28 normally switched on by an energy accumulator 27. The brake 28 is controllable and is regulated by the spring of energy accumulator 27 for holding permissible load suspended on cable 5. Brake 28 is equipped with braking chamber 29 and its control in the form of valve 30 and tubing 31 connecting it to chamber 29. For co-ordination of the joint work of the clutch of a vehicle and braking chamber 29 providing automatic engagement and disengagement of chamber 29 when clutch is being disengaged or engaged correspondingly, chamber control 29 is connected with the clutch control with the help of tubing through two-circuit valve 32. Braking chamber 29 and its control provide automatic braking reinforcement of brake system 28 when the load which is being lifted or lowered is stopped in the suspended state or when dynamic tensions appear on cable 5. Braking chamber 29 automatically releases the brake when the load is being lowered and brake 28 stays braked only by energy accumulator 27 which reduces torque necessary for overcoming braking of the brake 28 when lowering the load. As a result loading and wear of the hoist units and parts reduce and their durability increases.

The pulling hoist (without brake, FIGS. 1 and 2) operates as follows. In the initial position sun 25 is engaged with satellites of planetary gear 9 and stopping mechanism is blocked, that is, winding drum 4 through toothed-free-wheeling clutch 12 is connected to support 1. For unwinding cable 5 sun 25 is disengaged from satellites of planetary gear 9 by air cylinder 26, at the same time winding drum 4 is disconnected from support 1 and cable 5 is unwound manually and fixed by load-lifting hook 6 to the object of towing or stationary support. After fixing cable 5 air cylinder 26 is switched off and sun 25 under the action of spring 24 is engaged with satellites of planetary gear 9. In order to start up the pulling hoist, as shown in FIGS. 1 and 2, it is necessary on the vehicle: to switch off the clutch, to switch on the neutral of the transfer gearbox, to switch on the power take-off shaft of the transfer gearbox, to switch on the corresponding forward gear of the gear-box of a vehicle, and to switch on the clutch, and then the clutch of the vehicle is engaged. In this case the torque from power take-off shaft by means of conical gear 8, linking shaft 7 and planetary gear 9 is transferred to winding drum 4 and through cable 5 fixed to it and hook 6 to the towing object. Disconnection of winding drum 4 from support 1 is done as follows. As soon as the pulling rotation of winding drum 4 starts, half-clutch 14 acting by its wedge teeth 17 on wedge teeth 20 and 17 of ring 19 and half-clutch 15, presses out half-clutch 15 overcoming the force of spring 13, thus, providing disengagement of all the teeth of half-clutches; 14, 15. Having been disengaged wedge teeth 17 of half-clutches; 14, 15 become set against each other, and will sleep on their butt-ends. Extended forced tooth 18 at rotation of half-clutch 14 will be set against the cut surface of locking ring 19, will rotate it and will lock it relative to half-clutch 14 in the opposition of their wedge teeth 17, 20. It prevents the engagement of half-clutches 14, 15 at the pulling rotation of winding drum 4. Half-clutch 14 will rotate freely relative to half-clutch 15 and will rotate locking ring 19. Wedge teeth 17 of half-clutch 14 will pass consequently from stop on wedge teeth 17 of half-clutch 15 up to the stop on teeth 20 of locking ring 19, then again up to the stop on teeth 17 of half-clutch 15 and so on. To stop the hoist it is necessary to disengage the clutch of the vehicle, then engage neutral in the gear-box. In this case torque leading up to winding drum 4 will cease and it stops or turns in reverse direction either under the action of the load or the vehicle. When the towing object or the load rolls back, winding drum 4 begins to run and to rotate the clutch 14 connected to it in the reverse direction. Extended forced tooth 18 will turn relative to locking ring 19 within the limits of the clearance existing between it and the surface of cut 21 of locking ring 19, the wedge teeth of half-clutch 14 and ring 19 will shift to the position which excludes their setting against each other so that with further relative rotation will lead to engagement of half-clutches 14 and 15 under the action of spring 13, that is, it will lead to engagement of their force teeth 16 and winding drum 4 will stop. At the engagement of half-clutches 14 and 15 force teeth 16 become engaged earlier than wedge ones 17, that is achieved by the width of space between teeth 16 and 17. Being engaged earlier, force teeth 16, thus, hinder the contact of wedge teeth 17 with each other and prevent disengagement of half-clutches 14 and 15.

The operation of the pulling-lifting hoist (with brake, FIG.3) with cable 5 being unwound, in pulling mode and when stopped, as brake 28 is usually switched on and links rigidly half-clutch 15 with support 1 does not differ from the above described the pulling hoist operation. And at lowering loads from the position of stop the hoist operates as follows. When the load is in the lifted position it is held by braking action of brake 28 by energy accumulator 27. To lower the load it is necessary to disengage the clutch of the vehicle, at the same time brake 28 will be braked additionally by braking chamber 29, by means of compressed air delivery from the clutch control. Further, it is necessary to engage the rear gear of the gear box and to engage the clutch, at the same time chamber 29 will release the brake and under the cumulative action of the load weight and supplied torque the resistance of brake 28 is overcome and the load is being lowered smoothly. To stop the load in the process of its lowering or lifting it is necessary to disengage the clutch of the vehicle. At this time due to the connection of braking chamber 29 control and the clutch control through two-circuit valve 32, at clutch disengagement the braking chamber 29 is engaged automatically providing additional braking of brake 28 for taking up the load dynamic action on the hoist at the moment of stoppage. Braking chamber 29 can be braked with the help of valve 30 as well for reinforcement of the hoist braking when it is used for towing by the traction of the vehicle wheels on which it is mounted. Braking chamber 29 mustn't be braked by valve 30 when the load is being lowered so that not to overcome the additional braking of brake 28 in this case.

The hoist has been tested and the tests showed it capacity for work, reliability and considerable superiority over analogy in such characteristics as pulling speed of the cable, efficiency, specific mass, etc.

It will be apparent to those skilled in the art that various modifications can be made to the hoist driven by the transfer gearbox of a vehicle of the instant invention without departing from the scope or spirit of the invention, and it is intended that the present invention cover modifications and variations of the hoist driven by the transfer gearbox of a vehicle provided they come within the scope of the appended claims and their equivalents.

What is claimed is:

1. A hoist driven by a transfer gearbox of a vehicle comprising:

a winding drum mounted on a support;

a reduction gear including a winding-drum-stopping mechanism with a toothed-free-wheeling clutch connected to a linking shaft for allowing the winding drum to rotate in a pulling direction, and with the toothed-free-wheeling clutch for preventing the winding drum from rotating in a reverse direction with respect to the pulling direction, with the reduction gear a form of a toothed gear with the toothed-free-wheeling clutch having two counter sprung half-clutches with butt-end forced and wedged teeth, one of the half-clutches having an extended forced tooth and the other of the half-clutches having a locking ring with a slot and butt-end wedged teeth, the extended forced tooth entering into the slot of the locking ring, on the half-clutches the wedged teeth including rotated shift by half of the extended forced tooth width and with a high-power brake mounted on the external side of the reduction gear and connected sequentially with the toothed-free-wheeling clutch; and a winding-drum-switching mechanism.

2. The hoist according to claim 1, with the winding-drum-switching mechanism having a sprung sun gear mounted on the linking shaft and connected with an air cylinder fixed on a hoist support.

3. The hoist according to claim 2, with a brake mounted between the support and an additional shaft of the toothed-free-wheeling clutch, with the brake normally switched on by an energy accumulator and equipped with a braking chamber and a braking chamber control.

4. The hoist according to claim 2, with a braking chamber control connected with a clutch control of the vehicle by a two-circuit valve.

5. The hoist according to claim 1, with a brake normally switched on by an energy accumulator and equipped with a braking chamber and a braking chamber control.

6. The hoist according to claim 5, with the control for the braking chamber connected with a clutch control of the vehicle by a two-circuit valve.

7. The hoist according to claim 1, with a braking chamber control connected with a clutch control of the vehicle by a two-circuit valve.

8. A hoist comprising:

an input shaft;

a motor-transmission unit between the input shaft and a motor;

a winding drum mounted on a support;

a reduction gear having a gear with a low transmission ratio and a high efficiency;

a winding-drum-switching mechanism mounted between the input shaft and the winding drum, for disconnecting the winding drum when unwinding;

a winding drum stopping mechanism having a self-latching toothed-free-wheeling clutch connecting the winding drum to the support with the toothed-free-wheeling clutch connected to the linking shaft for allowing the winding drum to rotate in a pulling direction, and with the toothed-free-wheeling clutch for preventing the winding drum from rotating in a reverse direction with respect to the pulling direction; and a power take-off shaft of the transmission output shaft, connected to the input shaft of the hoist.

9. The hoist as set forth in claim 8, with said reduction gear having a conical gear, a linking shaft and a planetary gear, with the conical gear connected by the linking shaft to the planetary gear, said reduction gear including the winding-drum-stopping mechanism with a toothed-free-wheeling clutch connected to the linking shaft for allowing the winding drum to rotate in a pulling direction, and with the toothed-free-wheeling clutch for preventing the winding drum from rotating in a reverse direction with respect to the pulling direction.

10. A hoist comprising:

an input shaft;

a winding drum mounted on two supports;

a reduction gear having gears with a low ratio and a high efficiency, the reduction gear including a conical gear connected by a linking shaft to a planetary gear;

a winding-drum-switching mechanism mounted sequentially between the input shaft and the winding drum;

a winding-drum-stopping mechanism having a self-latching toothed-free-wheeling clutch and a normally switched-on brake sequentially counted between one of the shafts, for transferring the torque to the winding drum and one of the two supports; and a power take-off shaft connected to the input shaft of the hoist.

11. The hoist as set forth in claim 1, with said reduction gear having a conical gear, a linking shaft and a planetary gear, with the conical gear connected by the linking shaft to the planetary gear, said reduction gear including the winding-drum-stopping mechanism with a toothed-free-wheeling clutch connected to the linking shaft for allowing the winding drum to rotate in a pulling direction, and with the toothed-free-wheeling clutch for preventing the winding drum from rotating in a reverse direction with respect to the pulling direction.

12. The hoist as set forth in claim 10, with said reduction gear having a conical gear, a linking shaft and a planetary gear, with the conical gear connected by the linking shaft to the planetary gear, said reduction gear including the winding-drum-stopping mechanism with a toothed-free-wheeling clutch connected to the linking shaft for allowing the winding drum to rotate in a pulling direction, and with the toothed-free-wheeling clutch for preventing the winding drum from rotating in a reverse direction with respect to the pulling direction.

* * * * *